US006609485B2

(12) United States Patent
Murglin

(10) Patent No.: US 6,609,485 B2
(45) Date of Patent: Aug. 26, 2003

(54) PISTON PIN BUSHING COOLER

(75) Inventor: Joseph P. Murglin, Arlington Height, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 09/906,513

(22) Filed: Jul. 16, 2001

(65) Prior Publication Data

US 2002/0139322 A1 Oct. 3, 2002

Related U.S. Application Data

(63) Continuation-in-part of application No. 09/823,960, filed on Mar. 29, 2001.

(51) Int. Cl.[7] ..... F01B 31/08
(52) U.S. Cl. ..... 123/41.35; 123/41.36
(58) Field of Search ..... 123/41.36, 41.35, 123/193.6

(56) References Cited

U.S. PATENT DOCUMENTS 3,070,079 A * 12/1962 Seifert ..... 123/41.36
4,056,044 A * 11/1977 Kamman et al. ..... 123/41.35
4,253,429 A * 3/1981 Galli ..... 123/41.35
4,506,632 A * 3/1985 Kanda et al. ..... 123/41.35
4,508,065 A * 4/1985 Suchdev ..... 123/41.36
4,867,119 A * 9/1989 Cooper et al. ..... 123/41.35
4,986,167 A * 1/1991 Stratton et al. ..... 123/193.6
5,052,280 A * 10/1991 Kopf et al. ..... 123/41.35
5,307,732 A * 5/1994 Berlinger ..... 123/193.6
5,692,430 A 12/1997 McLaughlin et al.
5,845,611 A * 12/1998 Schmidt et al. ..... 123/41.35

* cited by examiner

*Primary Examiner*—Henry C. Yuen
*Assistant Examiner*—Jason Benton
(74) *Attorney, Agent, or Firm*—Dennis Kelly Sullivan; Susan L. Lukasik; Jeffrey P. Calfa

(57) ABSTRACT

A piston pin bore cooler for cooling and lubricating a piston pin bore bushings, piston pin and connecting rod bushings, includes an oil jet, the oil jet directing a spray of lubricating oil at the underside of a crown of a reciprocating piston for cooling the crown; and a deflector formed interior to a piston skirt presenting a deflector surface, the deflector surface intersecting the spray of lubricating oil for at least a portion of the duration of a each reciprocation of the reciprocating piston and deflecting the intersected the spray of lubricating oil to cool and lubricate the bushings. An opening is provided adjacent the deflector through which the spray may pass during other portions of the reciprocation. A deflector assembly, a piston skirt, and a method of cooling and lubricating a pin and bushings are further included.

12 Claims, 6 Drawing Sheets

SECTION B-B

PISTON PIN BUSHING COOLER

CROSS-REFERENCE TO RELATED APPLICATION

This patent application is a continuation-in-part of U.S. patent application Ser. No. 09/823,960 on Mar. 29, 2001.

TECHNICAL FIELD

The present invention relates to a piston assembly for an internal combustion engine. More particularly, the present invention relates to a piston assembly in cooperation with an oil piston cooling jet for effecting lubrication of the piston pin bushings.

BACKGROUND OF THE INVENTION

A piston assembly for an internal combustion engine generally becomes very hot during use, and is subjected to relatively severe thermal stresses as compared to other engine parts, especially on its top wall or crown portion which is directly exposed to the heat of the gases in the combustion chamber that is partly defined by the piston. This problem of heating of the crown of the piston assembly has become more and more severe with modern internal combustion engines, due to increases in thermal loading arising from increases in engine power output. Various schemes have been developed in the past for aiding with the cooling of such a piston assembly and presently, some form of active cooling of the piston assembly is seen to be quite necessary.

In particular, the concept of cooling the piston crown from below by injecting a flow of engine lubricant up into the space defined by the cup-shaped piston structure, including the piston crown and the piston skirt, so as to impinge against the lower side of the piston crown and to cool it, has been put forward in the past in various forms. In particular, it has been recognized that it is helpful for such lubricant cooling of the piston crown to provide a shaker chamber near the lower surface of the piston crown which defines a reservoir for temporarily and intermittently accumulating a pool of lubricant therein. The lubricant from this pool is splashed by means of inertia against the piston crown as the piston reciprocates in the cylinder bore.

Lubrication of components other than the crown is also essential. Typically, a piston is connected at one end to a connecting rod. The connecting rod includes an eye having a small end bushing that receives a piston pin such that the connecting rod pivots through a relatively small pivoting angle of the piston pin during reciprocation. The other end of the connecting rod is pivotally coupled to the crank shaft which also pivots through a relatively small angle. One area where it is desired to provide lubrication and cooling in the internal combustion engine is between the piston pin of the piston and the bushings supporting the piston pin. Such bushings reside in both the connecting rod and the pin bores of the piston top.

It is known to indirectly supply a lubricant such as oil to the piston pin by splashing the oil proximate the piston pin area. In one form, oil that is sprayed onto the piston undercrown area specifically for cooling the piston crown splashes onto the connecting rod eye of the connecting rod. Since the connecting rod is exposed about the piston pin, the oil wicks into the connecting rod eye bushing area defined between the piston pin in the connecting rod eye to provide lubrication. While the splash method does supply lubricant to the piston pin area, the amount of lubricant supplied to the piston pin by the splash method may not be satisfactory. In order to alleviate what has been seen as insufficient cooling/lubrication by means of the splash method, some engines now employ an active or positive method providing lubrication to the piston pin. Such a method has its own trade-offs in that it usually involves defining passages that supply lubrication under pressure to the piston pin. Such passages can be complicated to define and connect with a source of lubrication under pressure. Such passages may also affect the strength of the piston pin.

In view of the foregoing, there is a need to provide adequate cooling and lubrication to the piston pin and the bushings that support the piston pin. The method of providing such cooling and lubrication should be as simple as possible, involving a minimal number of changes to an existing design. Defining new passageways for lubricating fluid under pressure in an existing engine block design can be exceedingly expensive.

SUMMARY OF THE INVENTION

The piston pin bushing cooler of the present invention substantially meets the aforementioned needs of the industry. It is a simple design that provides for intermittent, but adequate spray of lubricant on the piston pin area for both cooling and lubrication of the piston pin bushings in the piston pin bore as well as in the connecting rod. The cooler utilizes an existing oil jet provided for in the block of the engine in cooperation with a deflector defined in the piston skirt. The particular oil jet used generates a stream of lubricant that is angularly displaced from the longitudinal axis of the cylinder within which the piston reciprocates. As a result of being angularly displaced from the longitudinal axis, the footprint of the lubricant striking the underside of the piston crown traces a somewhat elongate pattern once each reciprocation of the piston. The deflector of the present invention is designed to intersect the stream of oil for only a portion of the reciprocation of the piston. For the remainder of the period of reciprocation of the piston, the oil stream is directed to the oil gallery adjacent the underside of the crown of the piston. When the deflector intersects the oil stream, the oil is deflected onto the piston pin area for cooling and lubrication of the piston pin bushings.

The present invention is a piston pin cooler for cooling and lubricating piston pin bore bushings that includes an oil jet, the oil jet directing a spray of lubricating oil toward the underside of a crown of a reciprocating piston for cooling the crown; and a deflector formed interior to a piston skirt presenting a deflector surface, the deflector surface intersecting the spray of lubricating oil for at least a portion of the duration of each reciprocation of the reciprocating piston and deflecting the intersected spray of lubricating oil to cool and lubricate the piston pin bushings. A notch extending toward the skirt is disposed adjacent the deflector to provide an opening for the cooling jet spray to pass through to the oil gallery during other portions of the piston movement. The present invention is further a deflector assembly, a piston skirt, and a method of cooling and lubricating piston pin bushings, especially the piston pin bore bushings.

DETAILED DESCRIPTION OF THE PREFERRED EMBODIMENT

Figure 1:
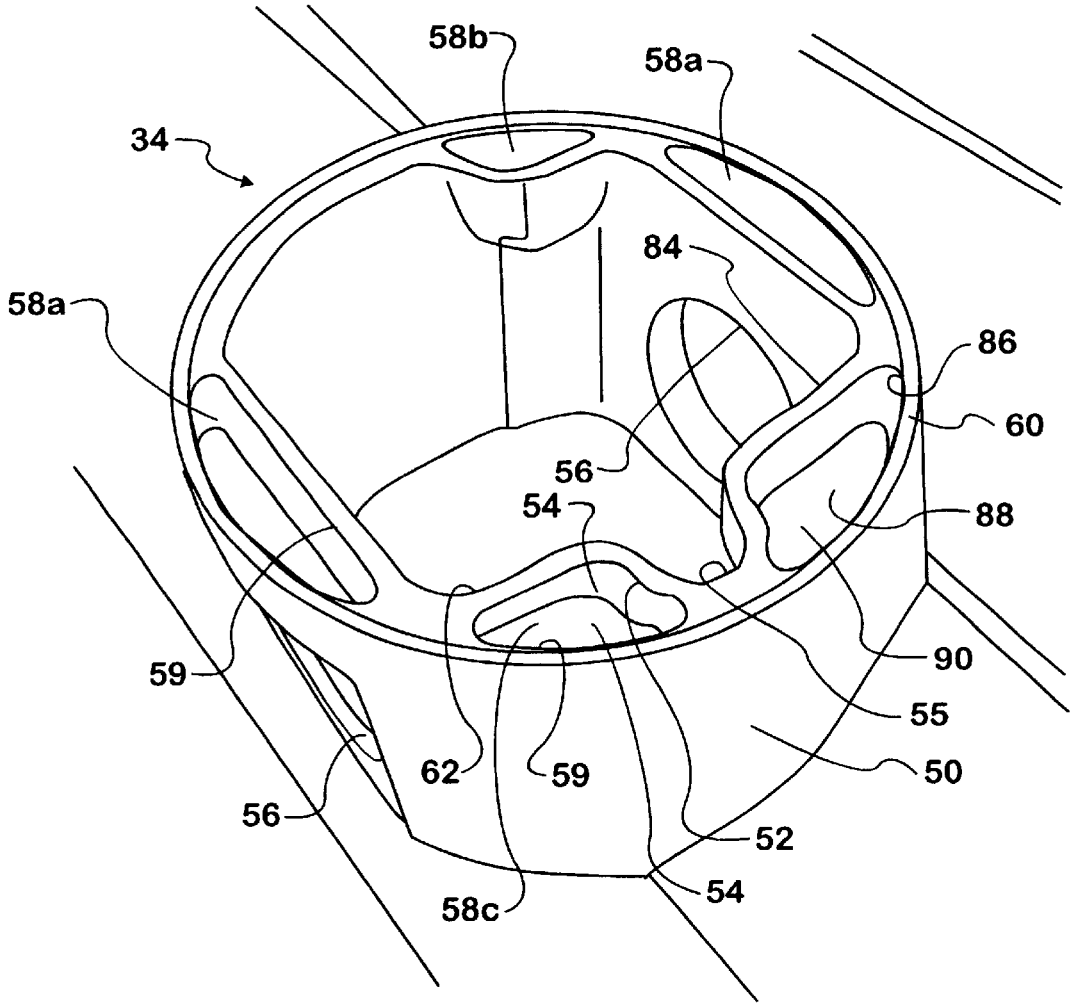
FIG. 1 is a perspective view of a piston skirt with an oil jet deflector of the present invention defined therein.

Referring to FIG. 2, a sectioned portion of an engine 10 is depicted. The engine 10 has a block 12. A sleeve 14 resides within the block 12. The sleeve 14 defines a cylinder within which a piston reciprocates. The sleeve 14 has a longitudinal axis 15 that is centrally disposed within the sleeve 14.

A combustion chamber 16 is defined in the top portion of the sleeve 14. The combustion chamber 16 is defined in part by the interior walls of the sleeve 14, the crown 36 (described in detail below) and the cylinder head (not shown) that is disposed on top of the block 12.

A bearing housing 18 is defined in the lower portion of the block 12. The bearing housing 18 supports a crankshaft (not shown) that is rotatably coupled to a big end eye 22 of a connecting rod 20. The connecting rod 20 further defines an eye having a bushing 24. A piston pin 26 is disposed in the bushing 24. It is noted that the longitudinal axis of the piston pin 26 intersects the longitudinal axis 15 of the sleeve 14.

The piston pin 26 rotatably couples the connecting rod 20 to a articulated piston 30. The articulated piston 30 has a top 32 and a skirt 34. Preferably, the top 32 is formed of a steel material while the skirt 34 is formed of an aluminum material.

The top 32 of the articulated piston 30 has an upwardly directed crown 36 that, as previously noted, forms in part the variable displacement combustion chamber 16. A plurality of ring grooves 38 are defined at the side margin of the top 32. Interior to the ring grooves 38 is an annular oil gallery 40. The annular oil gallery 40 extends close to the crown 36 to effect crown cooling and is open along the lower margin of the top 32.

Figure 4:
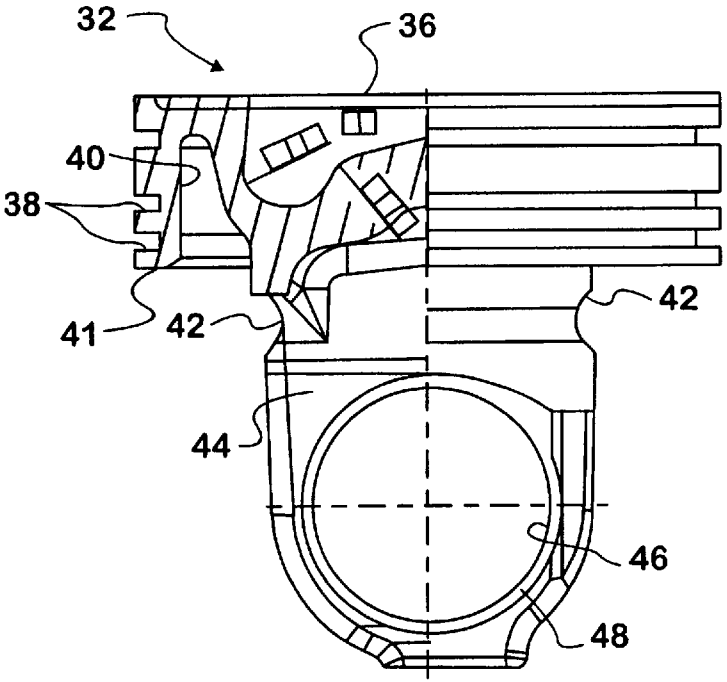
FIG. 4 is a side elevational view of the top of the articulated piston as depicted in FIG. 3, but rotated 90 degrees therefrom, the left half also being depicted in section.
Figure 3:
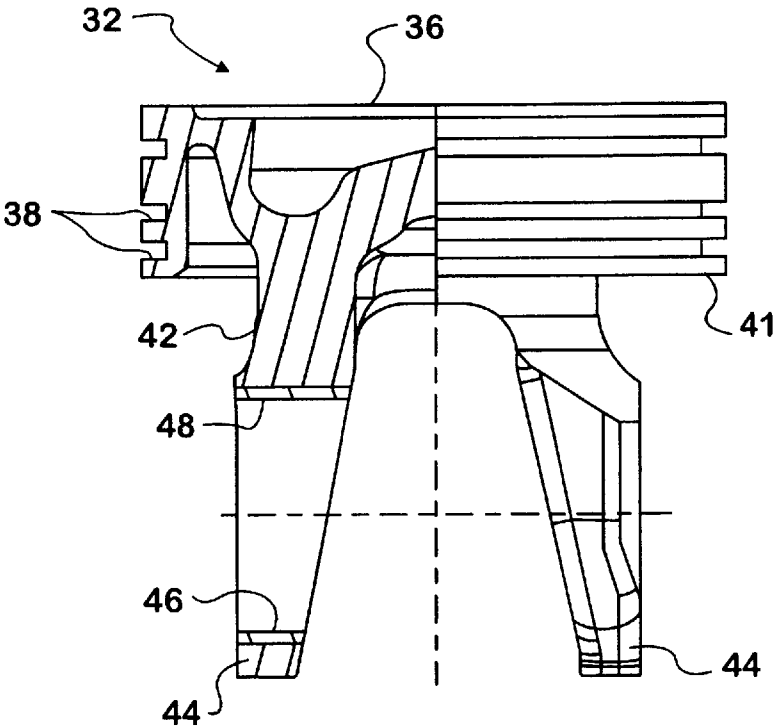
FIG. 3 is a side view of the top of the articulated piston, with the left half thereof being depicted in section.

A support 42 depends from the underside of the crown 36. The support 42 terminates in two spaced apart piston pin struts 44, as depicted in FIGS. 3 and 4. Each of the piston pin struts 44 has a pin bore 46 defined therein. The inner margin of the pin bore 46 includes a bushing 48 for rotatably supporting the piston pin 26. In this manner, the piston pin 26 couples the top 32 of the piston 30 to the connecting rod 20.

Figure 8:
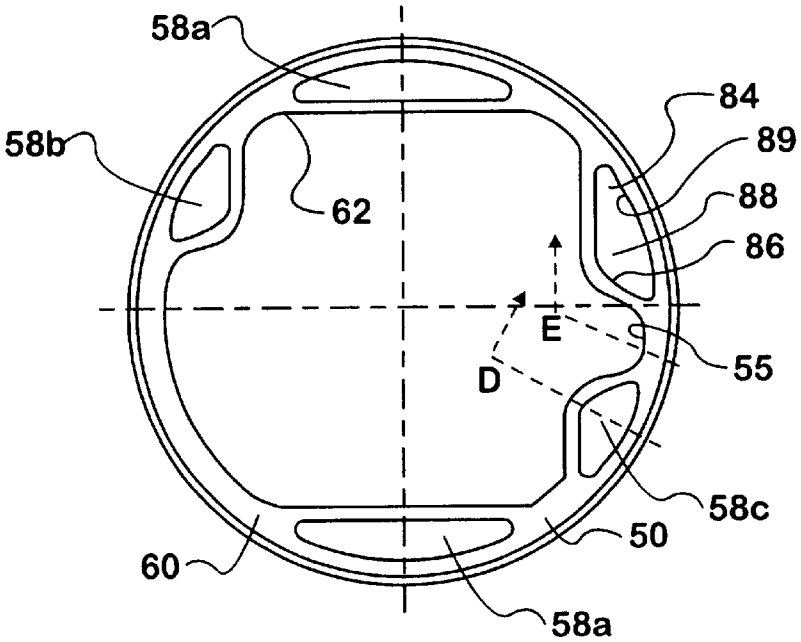
FIG. 8 is a top plan view of the skirt of the articulated piston.

The skirt 34 of the articulated piston 30 is depicted in FIGS. 1, 2*a*, 2*b*, and 5–8. The skirt 34 has a tubular body 50 that defines an interior space 62. Tubular body 50 an upper margin 60 that is generally circular as depicted in FIG. 8.

Figure 6:
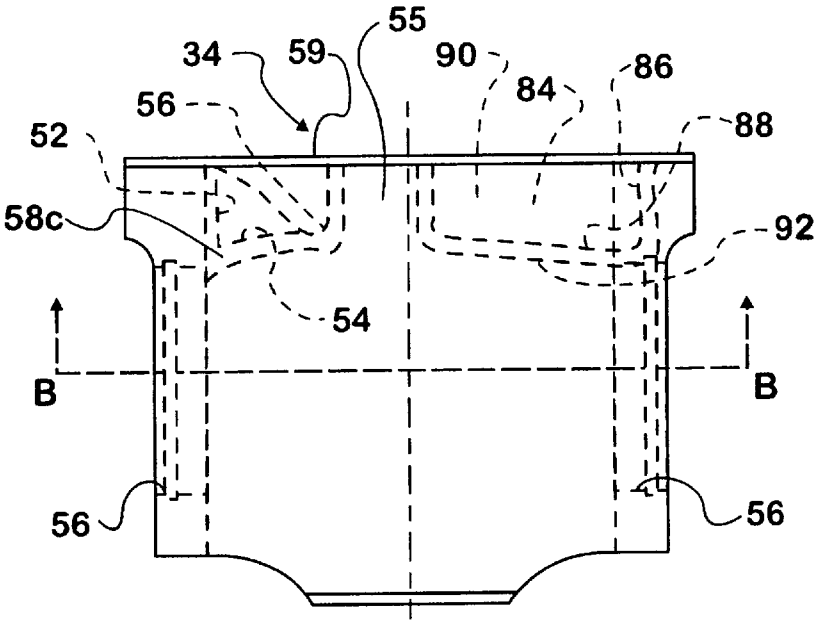
FIG. 6 is a side elevational view of the skirt of the articulated piston of FIG. 5 rotated 90 degrees with certain components being depicted in phantom.
Figure 5:
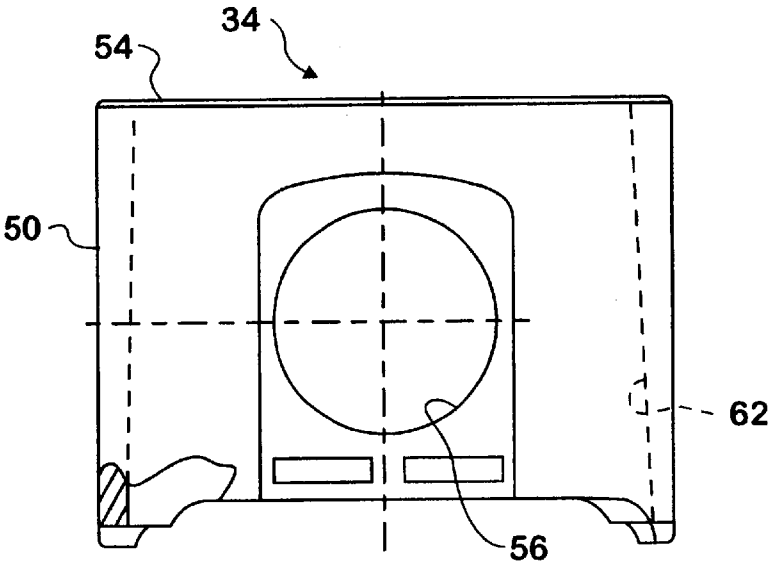
FIG. 5 is a side elevational view of the skirt of the articulated piston with certain components depicted in phantom.
Figure 7:
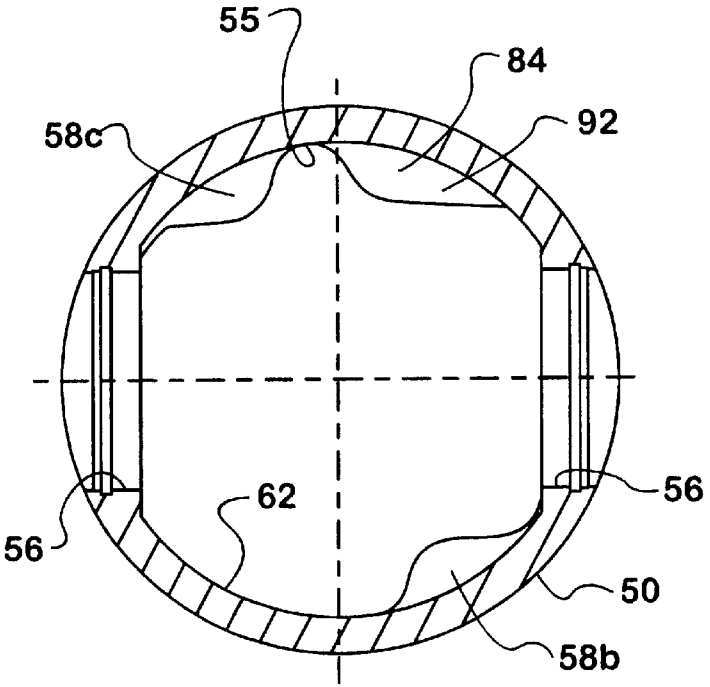
FIG. 7 is a sectional view of the skirt of the articulated piston taken along the section line B—B of FIG. 6.

A pair of opposed pin bores 56 extend through the wall of the tubular body 50, as depicted in FIGS. 5–7. The opposed ends of the piston pin 26 rotatably reside in respective pin bores 56, thereby coupling the skirt 34 to the top 32 to form the articulated piston 30.

A plurality of oil trays 58*a*, 58*b*, 58*c* are defined proximate the upper margin 60 of the tubular body 50. Each of the oil trays 58 has sidewalls 52 and a bottom 54. The oil trays 58 are cup-shaped, having an upward directed opening 59. As depicted in FIG. 2, when the skirt 34 is mated to the top 32, the oil trays 58 underlie portions of the annular oil gallery 40 to define the shaker in which oil is temporarily retained and splashed by inertia on the underside of the crown 36 of the top 32.

Figure 2A:
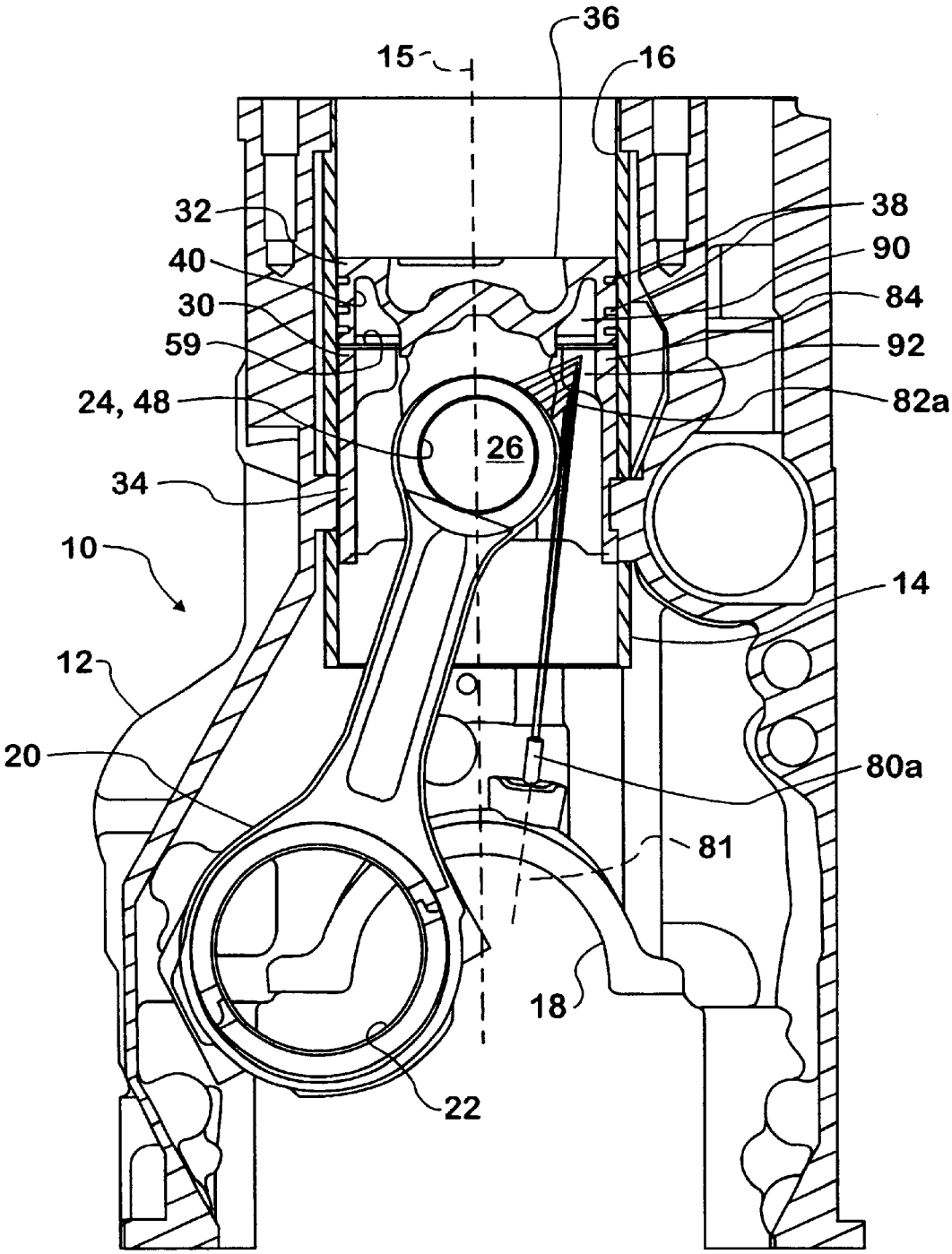
FIG. 2*a* is a side sectional view of an engine depicting an oil jet delivering a stream of oil impinging on the deflector and being deflected onto the piston pin.

The piston pin bushing cooler of the present invention includes an oil jet 80*a* as depicted in FIG. 2*a*. In a preferred embodiment, the oil jet 80*a* is an existing oil jet in a selected engine 10. The oil jet 80*a* is fluidly in communication with an oil passageway defined in the block 12 that conveys lubricating oil under pressure to the oil jet 80*a*. The axis 81 of the oil jet 80*a* has a compound angular displacement relative to the axis 15 of the sleeve 14 such that the axis 81 will not lie in any plane that includes the axis 15. Accordingly, the oil jet 80*a* is not coaxial with the sleeve 14 but rather extends at an angle to the path of the piston skirt. As a result of this compound angular displacement, the spray 82*a* emanating from the oil jet 80*a* does not impact the underside of the crown 36 at a single point all the time, but has an elongate footprint that moves back and forth with each reciprocation of the articulated piston 30 within the sleeve 14. It is understood that the axis of the oil jet could be other than as described and the cooling/lubrication of the present invention is just as effective.

The oil jet 80*a* of the piston pin bushing cooler operates in cooperation with the deflector 84. The deflector 84 is formed proximate the upper margin 60 of the tubular body 50 the skirt 34 and projects inward relative to the tubular wall of the skirt 34 and is separated by a U-shaped notch 55 disposed between the deflector and the adjacent oil tray 58*c*, the notch extending toward the tubular wall to provide an opening permitting the spray 82*a* from the jet to pass the deflector 84 and tray 58*c* to the oil gallery 40 during certain portions of the travel of the piston 30. The deflector 84 is formed of a sidewall 86 and a bottom 88 and has an upward directed opening 89 to form a cup shape similar to but substantially circumferentially wider than that of the tray 58*c* so that the lower portion of the deflector 84 will deflect the spray 82 during portions of the piston travel. When the skirt 34 is mated to the top 32, the deflector 84 forms a shaker 90 in cooperation with the annular oil gallery 40.

When viewed upward into the interior space 62 defined within the tubular body 50, the deflector 84 has underside margin 92 that in facts performs the deflecting operation. The underside margin 92 is best depicted in FIGS. 6 and 7.

In operation, the oil jet 80*a* continuously provides a generally upward directed spray 82*a* through the interior space 62 defined within the tubular body 50 toward the underside of the crown 36 of the top 32. As the piston 30 reciprocates within the sleeve 14, the point of impact of the spray 82*a* traces the aforementioned elongate footprint. For a portion of the reciprocation, the point of impact of the spray 82*a* is directed through the notch 55 into the annular oil gallery 40. At a point in the reciprocation of the piston 30, the underside margin 92 of the deflector 82*a* intersects the spray 82*a* and deflects the spray 82*a* onto the piston pin 26 as depicted in FIG. 2*a*. The deflected oil both cools and lubricates the bushings 24, 48 that support the piston pin 26. This is an efficient cost effective means of providing the positive effects of active lubrication of the piston pin bushings without having to form additional oil passages. Since the spray 82*a* is intercepted for only a portion of the reciprocation, the majority of the oil directed into the annular oil gallery 40 for cooling of the crown 36.

Figure 2B:
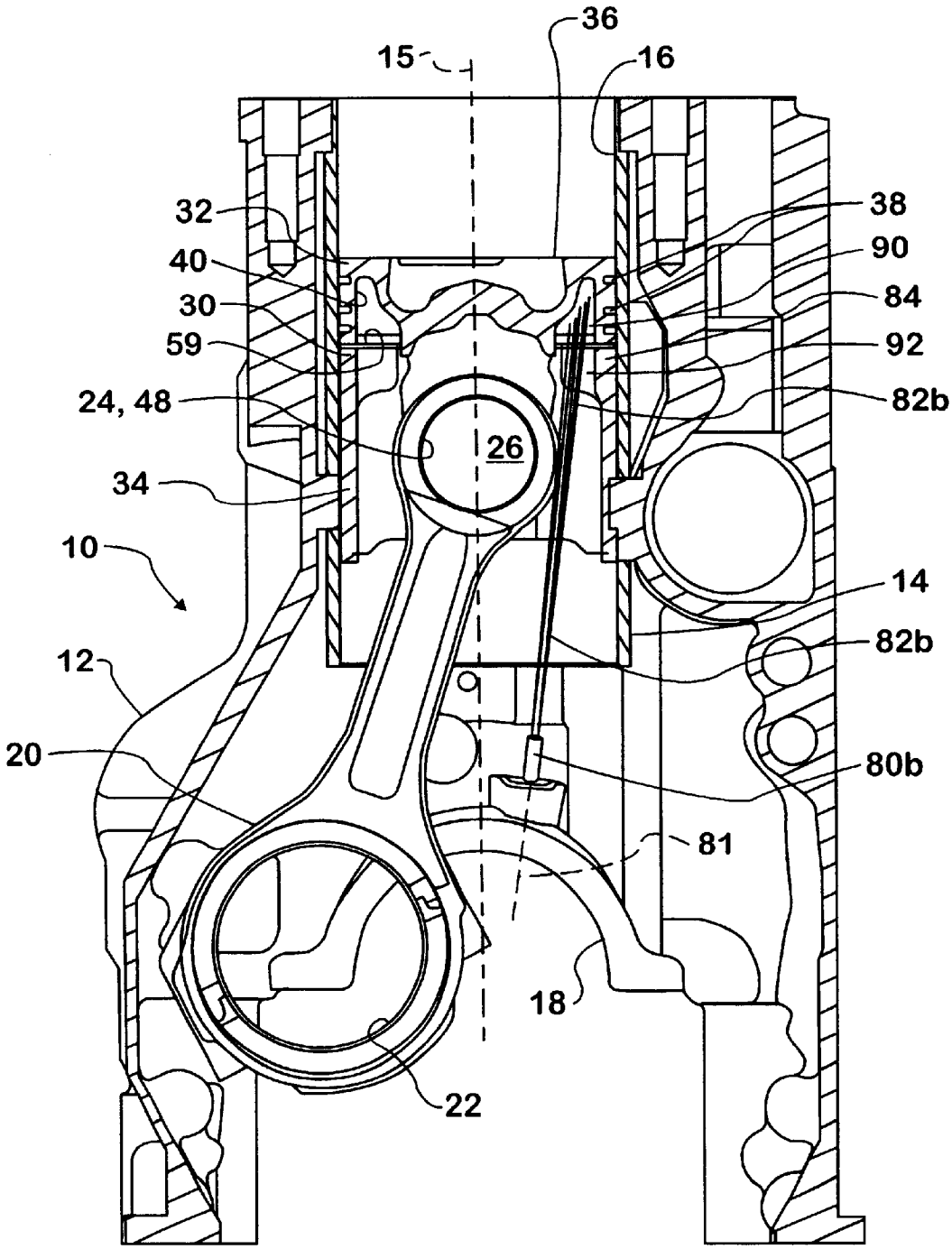
FIG. 2*b* is a side sectional view of an engine similar to FIG. 2*a* but depicting an additional oil jet delivering a stream of oil to the cooling gallery without encountering a deflector.

In an additional embodiment, a second oil jet 80*b* shown in FIG. 2*b* may also be used. The second oil jet 80*b* directs its oil spray 82*b* into the annular oil gallery 40 in the same manner but from the axially opposite side of the cylinder and is not deflected. In this way, it is assured that the important cooling of the crown 36 is still achieved with an undeflected spray 82*b*. Since the deflector 84 is disposed at only one location on the piston while the trays 58*a*, 58*b*, and 58*c* are not in a position to deflect the spray 82*b*. The second jet 80*b* is located to spray at a reverse angle of the same amount as the jet 80*a* to provide the additional advantage that the piston can be inserted in the bore in with the deflector 84 toward either the front or the rear of the engine and will operate in the same manner since either spray 80*a* or 80*b* will be deflected while the other spray will not be contacted by the deflector 84.

While presently preferred embodiments of the invention have been illustrated and described, it should be appreciated that principles of the invention are applicable to all embodiments that fall within the scope of the following claims.

What is claimed is:

1. In combination with an engine having a source of lubricating oil under pressure, a piston pin bushing cooler for cooling and lubricating piston pin bushings, comprising:

an oil jet in fluid communication with said source, the oil jet being disposed to direct a spray of lubricating oil, the spray bearing on an underside portion of a crown of a reciprocating piston for cooling the crown; and a deflector formed on said piston interior to a piston skirt thereof and presenting a deflector surface, the deflector surface intersecting the spray of lubricating oil for at least a portion of the duration of each reciprocation of the reciprocating piston and deflecting the intersected spray of lubricating oil to cool and lubricate the piston pin bushings.

2. The invention of claim 1 wherein the deflector is formed proximate an upper margin of the piston skirt.

3. The invention of claim 2 wherein the deflector projects inward from a piston skirt body outer margin.

4. In combination with an engine having a crankcase and a plurality of cylinders, a deflector assembly for aiding in cooling and lubricating piston pin bushings, the deflector acting in cooperation with an oil jet disposed on said crankcase, the oil jet directing a spray of lubricating oil in a direction which is skewed relative to an axis of a cylinder toward the underside of a crown of a reciprocating piston having a cooling gallery for cooling the crown, the deflector assembly comprising:

a deflector formed interior to a piston skirt and adjacent to an opening extending toward the piston skirt presenting a deflector surface, the deflector surface intersecting the spray of lubricating oil for at least a portion of the duration of a reciprocation of the reciprocating piston and deflecting the intersected spray of lubricating oil to cool and lubricate the piston pin bushings, the spray passing through said opening to the cooling gallery during other portions of the duration of a reciprocation of the reciprocating piston.

5. The deflector assembly of claim 4 wherein the deflector is formed proximate an upper margin of a piston skirt.

6. The deflector assembly of claim 5 wherein the deflector projects inward from a piston skirt body outer margin and said opening does not extend to said piston skirt body outer margin.

7. A piston skirt being a component of a articulated piston, comprising:

a deflector formed interior to the piston skirt presenting a deflector surface, the deflector acting in cooperation with an existing oil jet, the oil jet directing a spray of lubricating oil at the underside of a crown of a reciprocating piston for cooling the crown, the deflector surface intersecting the spray of lubricating oil for at least a portion of the duration of a each reciprocation of the reciprocating piston and deflecting the intersected the spray of lubricating oil to cool and lubricate the piston pin bushings.

8. The piston skirt of claim 7 and a tray formed interior to the piston skirt on the same side of the piston pin as the deflector and a notch defined between said deflector and said tray, the spray of lubricating oil passing through the notch for at least a portion of the duration of a each reciprocation of the reciprocating piston.

9. The piston skirt of claim 8 wherein the deflector is formed proximate an upper margin of a piston skirt body.

10. The piston skirt of claim 9 wherein the deflector projects inward from a piston skirt body outer margin.

11. A method of cooling and lubricating piston pin bore bushings, the piston pin bore bushings being disposed in a reciprocating piston, comprising:

directing a spray of oil at the underside of a piston crown;

bearing the spray on the underside of the crown for a first portion of the duration of each reciprocation of the piston;

intersecting the spray of oil at least a second portion of the duration of each reciprocation of the piston with a deflector; and deflecting the intersected spray of oil to cool and lubricate the piston pin bore bushings.

12. The method of claim 11, wherein an opening is defined adjacent the deflector toward the piston skirt, further including the step of directing the spray of oil through the opening during a portion of the duration of each reciprocation.

* * * * *